US005078922A

United States Patent [19]

Collins et al.

[11] Patent Number: 5,078,922

[45] Date of Patent: Jan. 7, 1992

[54] LIQUID SOURCE BUBBLER

[75] Inventors: Craig C. Collins; Michael A. Richie; Fred F. Walker, all of Santa Cruz; Brian C. Goodrich, Los Gatos; Lowell B. Campbell, Santa Cruz, all of Calif.

[73] Assignee: Watkins-Johnson Company, Palo Alto, Calif.

[21] Appl. No.: 601,270

[22] Filed: Oct. 22, 1990

[51] Int. Cl.[5] ..... B01F 3/04

[52] U.S. Cl. ..... 261/139; 261/124; 261/129; 261/153

[58] Field of Search ..... 261/129, 139, 153, 124

[56] References Cited

U.S. PATENT DOCUMENTS

| | | | |
|---|---|---|---|
| 2,650,808 | 9/1953 | Cohen et al. | 261/153 |
| 3,539,165 | 11/1970 | Ingels | 261/153 |
| 3,659,604 | 5/1972 | Melville et al. | 261/139 |
| 3,987,133 | 10/1976 | Andra | 261/124 |
| 4,134,514 | 1/1979 | Schumacher et al. | 261/124 |
| 4,477,395 | 10/1984 | Albarda | 261/129 |
| 4,482,509 | 11/1984 | Iannelli | 261/124 |
| 4,597,917 | 7/1986 | Lunsford | 261/153 |
| 4,859,375 | 8/1989 | Lipisko et al. | 261/121.1 |
| 4,861,524 | 8/1989 | Sielaff et al. | 261/153 |

*Primary Examiner*—Tim Miles

*Attorney, Agent, or Firm*—Flehr, Hohbach, Test, Albritton & Herbert

[57] ABSTRACT

An improved bubbler has walls formed of thin stainless steel. A hollow cylindrical body member forms a cylindrical sidewall and has welded to it a top end cap and a bottom end cap. A horizontally disposed sparger tube is connected to the carrier-gas inlet tube and is positioned within the bubbler chamber adjacent to the bottom end cap. The sparger tube has a plurality of horizontally spaced-apart exit holes formed therein for providing a plurality of carrier-gas streams into the liquid chemical. The carrier gas bubbles up through the liquid chemical, causing the liquid chemical to vaporize and diffuse into the carrier gas. A substantially uniform temperature throughout the chemical liquid is provided with a heat-conductive enclosure formed of aluminum plates which are thicker than the walls of the bubbler chamber and which contact and entirely surround the exterior surface of the stainless steel bubbler chamber. Heating and cooling means are also provided for controlling the temperature of the liquid chemical in the bubbler chamber at a predetermined temperature. The bubbler chamber includes additional features such as a dimple formed in the bottom end cap to prevent reflection of light from a laser liquid-level sensor unit. The liquid-chemical inlet tube terminates within a well formed in the bottom end cap to facilitate back flushing of the bubbler chamber.

13 Claims, 4 Drawing Sheets

LIQUID SOURCE BUBBLER

BACKGROUND OF THE INVENTION

1. Field of the Invention

This invention relates to bubblers for converting a liquid chemical to a chemical vapor by bubbling a carrier gas through a liquid chemical.

2. Prior Art

As referred to in the Lipisko et al. U.S. Pat. No. 4,859,375, prior bubblers utilize a single carrier-gas inlet tube which is immersed in the liquid chemical and which has a single gas outlet hole positioned near the bottom level of the liquid chemical to provide a single stream of carrier-gas bubbles through the liquid chemical. Some of the liquid chemical material is vaporized by the carrier-gas to form a chemical vapor.

Bubbler chambers are formed as quartz ampules, which are fragile and which also may have problems with maintaining the seals at their glass-to-metal interfaces.

Bubbler chambers are also formed as refillable stainless steel cylinders, which are manufactured from a machined-casting body with a removable top coverplate. The top coverplate is removably sealed to the body with a gasket, providing a potential source of contamination to the chemicals within the bubbler. The temperature of the chemical liquid in these bubbler chambers is controlled by heater elements.

Spargers are devices for introducing a stream of gas into a liquid in the form of gas bubbles. As described on page 140 of the book by Robert E. Treybal entitled *Mass-Transfer Operations, 3rd Edition*, McGraw-Hill, 1980, a sparger with more than one orifice may be used for vessels having a diameter greater than 0.3 meters.

SUMMARY OF THE INVENTION

It is therefore an object of the invention to provide a bubbler which if formed of relatively inexpensive materials.

It is another object of the invention to provide a bubbler which has precise temperature control.

It is another object of the invention to provide an improved bubbling mechanism.

In accordance with these and other objects of the invention, an improved bubbler is provided for vaporizing a chemical liquid by bubbling a carrier gas through the liquid chemical. The bubbler includes an enclosed stainless steel cylindrical bubbler chamber for containing a liquid chemical. The chamber has walls formed of thin stainless steel. A hollow cylindrical body member forms a cylindrical sidewall and has welded to it a top endwall and a bottom endwall. A liquid-chemical inlet tube passes through the top endwall to provide liquid chemical to the bubbler chamber. A carrier-gas inlet tube passes through the top endwall to provide a carrier gas to the bubbler chamber. A horizontally disposed sparger tube is connected to the carrier-gas inlet tube and is positioned within the bubbler chamber adjacent to the bottom endwall. The sparger tube has a plurality of horizontally spaced-apart exit holes formed therein for providing a plurality of carrier-gas streams into the liquid chemical. The carrier gas bubbles up through the liquid chemical, causing the liquid chemical to vaporize and diffuse into the carrier gas. A vapor outlet tube passes through the top endwall and passes the carrier gas and vaporized liquid chemical out of the bubbler chamber.

Temperature control means are used to provide a substantially uniform temperature throughout the chemical liquid. These include a heat-conductive enclosure formed of aluminum plates which are thicker than the walls of the bubbler chamber and which contact and entirely surround the exterior surface of the stainless steel bubbler chamber. A heat-insulating layer surrounds the exterior surface of the heat conductive enclosure. Heating and cooling means are also provided for controlling the temperature of the liquid chemical in the bubbler chamber at a predetermined temperature.

A dimple is formed in the bottom endwall to prevent reflection of light from a laser liquid-level sensor unit off of the interior surface of the bottom endwall of the bubbler chamber.

The liquid-chemical inlet tube terminates within a well formed in the bottom endwall to facilitate back flushing of the bubbler chamber through the liquid-chemical inlet tube.

BRIEF ION OF THE DRAWINGS

The accompanying drawings, which are incorporated in and form a part of this specification, illustrate embodiments of the invention and, together with the description, serve to explain the principles of the invention:

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 2:
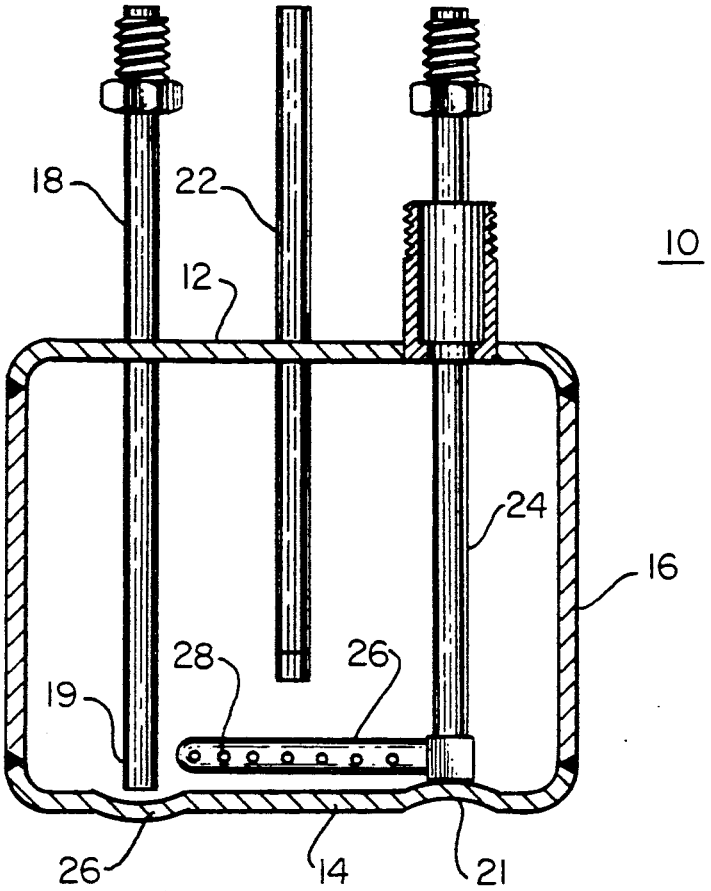
FIG. 2 is a sectional view taken along section line 1—1 of FIG. 1.
Figure 1:
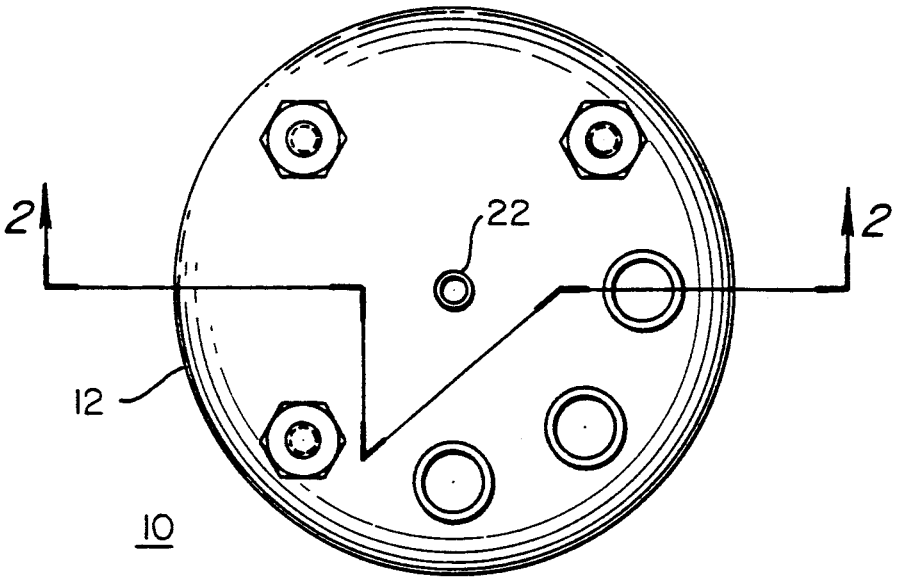
FIG. 1 is a plan view of a bubbler chamber according to the invention.
Figure 4:
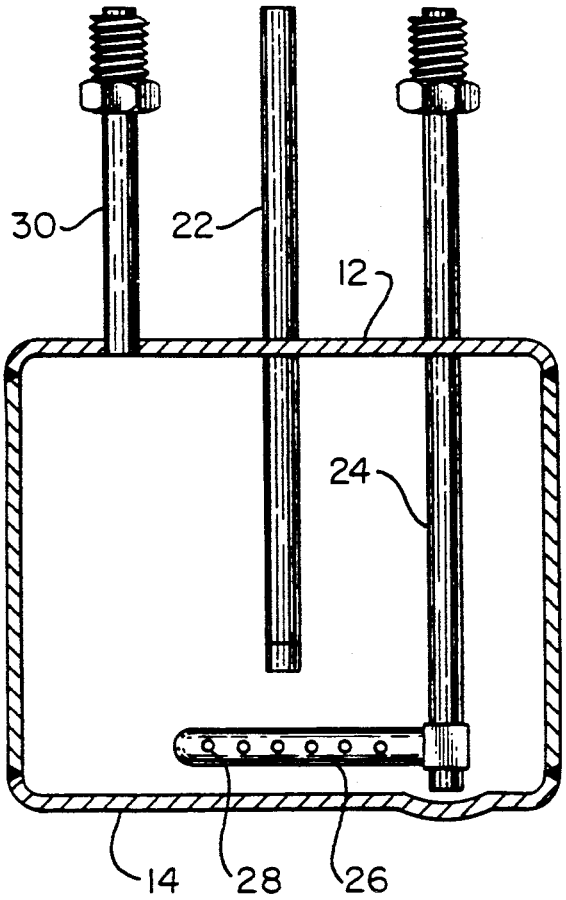
FIG. 4 is another sectional view taken along section line 4—4 of FIG. 3.

FIGS. 1 and 2 show a cylindrical bubbler chamber 10 used for vaporizing a liquid chemical, which is contained within the chamber, by bubbling a carrier gas through that liquid chemical. The bubbler chamber is a sealed unit formed of welded 16-gauge 316L stainless steel. This construction of a bubbler chamber does not use gaskets to eliminate contaminant entry. The bubbler chamber has a diameter of 5 inches and a height of 4 inches. The bubbler chamber is formed as a gasketless, hollow cylindrical body having a cylindrical sidewall portion 16 to which are TIG-welded a top endwall portion 12 and a bottom endwall portion 14. A tube 22 extending into the bubbler chamber is provided for a thermocouple to measure the temperature of the liquid chemical.

A stainless steel ¼ inch diameter liquid-chemical inlet tube 18 is connected through the top endwall 12 of the bubbler chamber to provide liquid chemical to the bubbler chamber. The end 19 of the inlet tube 18 is positioned adjacent to a concave dimple 20 formed in the bottom endwall 14 to serve as a sump for liquid chemical when the bubbler chamber is back flushed, for example, in a cleaning operation. Note that a convex dimple 21 is also formed in the bottom endwall to prevent reflection of light, provided by a laser liquid-level sensor unit, not shown, from the interior surface of the bottom end cap of the bubbler chamber.

A tube 22, extending into the bubbler chamber, is provided for a thermocouple to measure the temperature of the liquid chemical.

Figure 3:
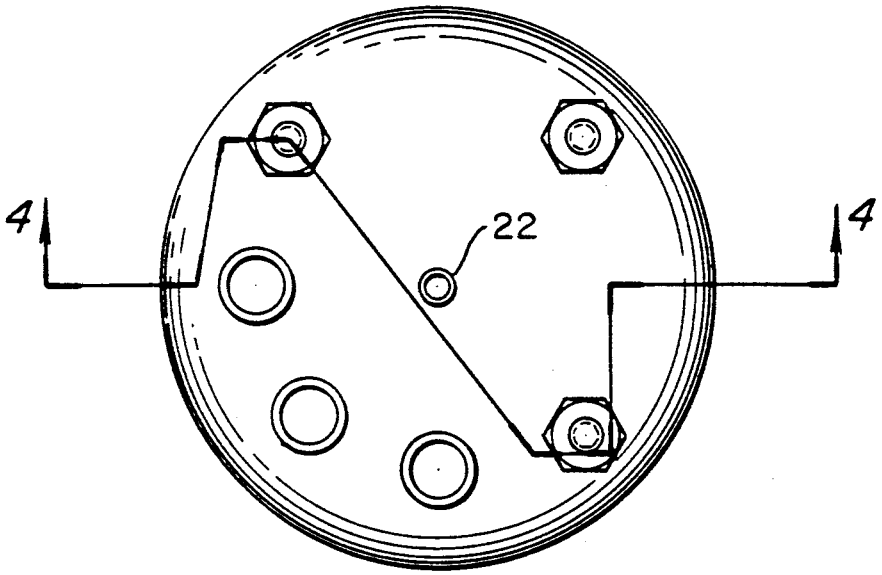
FIG. 3 is another plan view of the bubbler chamber according to the invention.

FIGS. 1 and 3 show another stainless-steel ¼ inch carrier-gas inlet tube connected through the top wall 12 to the bubbler chamber for providing a carrier gas to the bubbler chamber. A sparger tube 26 is connected to the end of the carrier-gas inlet tube 24 and is positioned within the bubbler chamber adjacent to the bottom endwall 14. The sparger tube 26 has a plurality of spaced-apart exit holes 28 formed therein for providing a plurality of carrier-gas streams into the liquid chemical in the bubbler chamber. The carrier gas bubbles up through the liquid chemical and causes the liquid chemical to vaporize and diffuse into the carrier gas. A number of relatively small 0.020 inch, horizontally-placed exit holes 28 are provided along the front and back sides of the sparger tube 26 to thereby cause the liquid chemical to be mixed to maintain a substantially uniform temperature throughout.

A ¼ inch stainless-steel vapor outlet tube 30 is connected through the top endwall 12 of the bubbler chamber for passing the carrier gas and vaporized liquid chemical out of the bubbler chamber.

Figure 5:
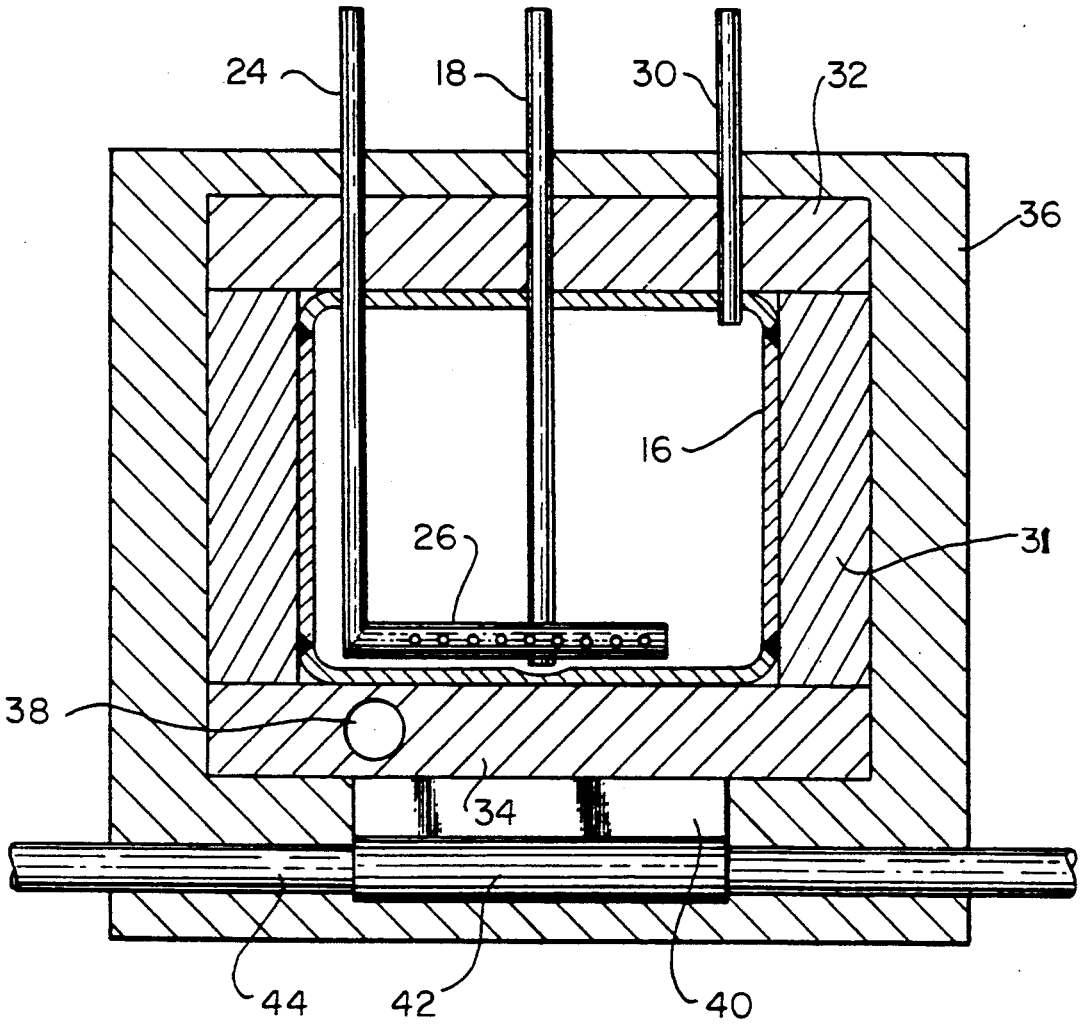
FIG. 5 is a sectional view of a bubbler system, showing the bubbler chamber, heat-conductive enclosure, and heat-insulating layer.

FIG. 5 shows a heat-conductive enclosure which provides a substantially uniform temperature throughout the chemical liquid. The heat-conductive enclosure is formed of aluminum plates, including a cylindrical sidewall 31, a top cover 32, and a bottom cover 34. These plates are thicker than the walls of the bubbler chamber and entirely surround the exterior surface of the stainless steel bubbler chamber 10. A suitable heat-conductive material is provided between the exterior walls of the bubbler chamber and various plates of the heat-conductive enclosure, as desired, to increase thermal conductivity.

A heat-insulating 36 further surrounds the heat-conductive enclosure, as shown in the figure layer surrounding the exterior surface of the heat conductive enclosure.

Heating the heat-conductive enclosure is accomplished with a conventional cartridge heater 38, indicated as being fixed in the bottom plate 34 of the heat-conductive enclosure. Cooling of the heat-conductive enclosure is accomplished with a thermoelectric cooler 40, having a heat-exchanger 42, through which cooling water is passed through a pipe 44.

Figure 6:
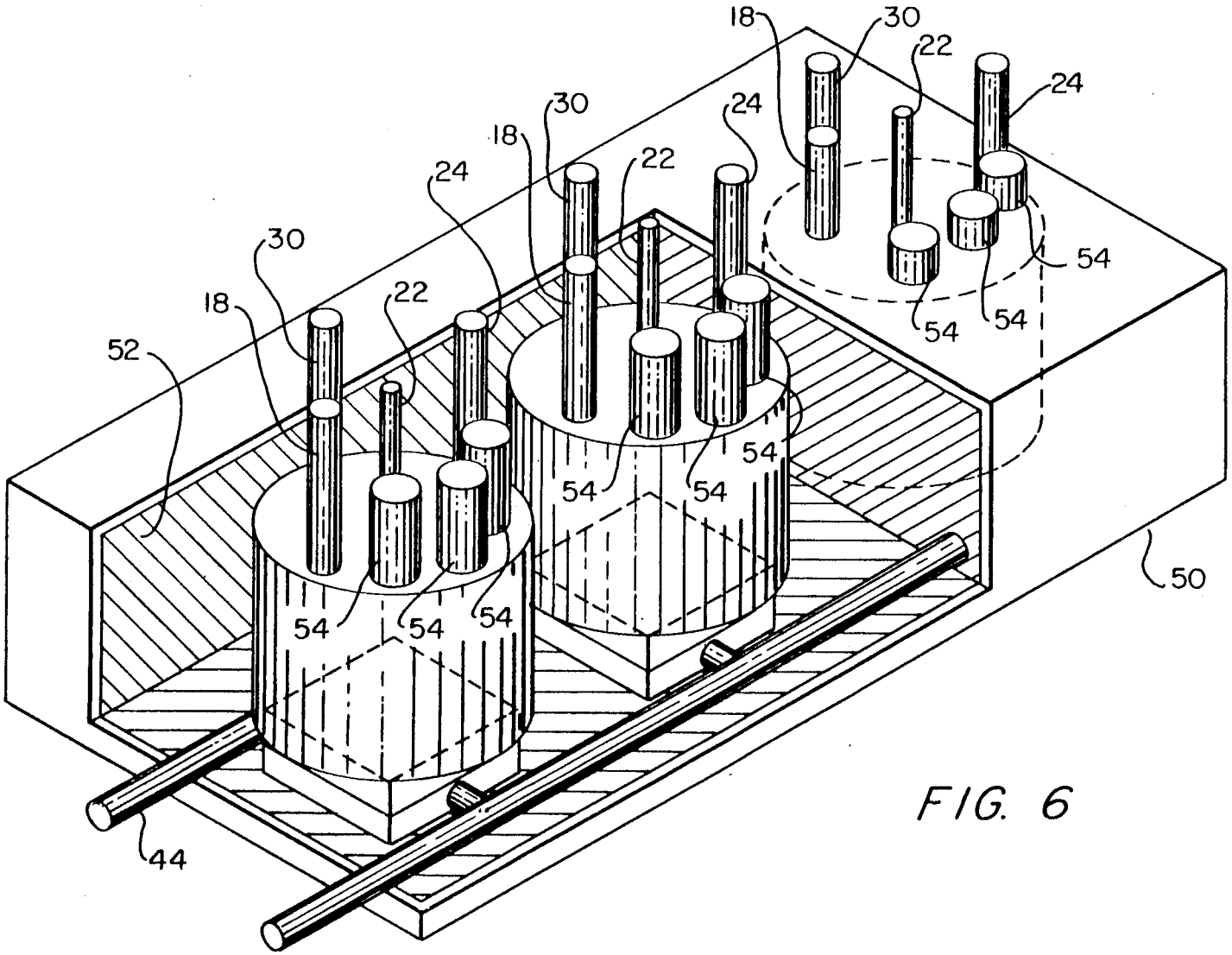
FIG. 6 is a perspective, partially cutaway view of a plurality of bubbler system within an enclosure.

FIG. 6 shows an container 50 for containing a plurality of bubbler systems 10 in an insulating material 52, which surround each system. Each system includes three liquid-level sensor modules 54 for monitoring low, high, and standard liquid-chemical levels.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodi-ments were chosen and described in order to best explain the principles of the invention and its practical applica-tion, to thereby enable others skilled in the art to best utilize the invention and various embodiments with various modifications as are suited to the particular use con-templated. It is intended that the scope of the invention be defined by the claims appended hereto and their equivalents.

We claim:

1. An improved bubbler system for vaporizing a liquid chemical by bubbling a carrier gas through the liquid chemical, comprising:

an enclosed, gasketless cylindrical bubbler chamber formed as a hollow cylindrical body member having a cylindrical sidewall portion and having a top endwall portion and a bottom endwall portion, said cylindrical bubbler chamber providing an interior volume for containing the liquid chemical therein;

a liquid-chemical inlet tube connected to said bubbler chamber for providing liquid chemical to said bubbler chamber;

a carrier-gas inlet tube connected to said bubbler chamber for providing a carrier gas to said bubbler chamber;

a sparger tube connected to said carrier-gas inlet tube and positioned within the bubbler chamber adjacent to the bottom endwall, said sparger tube having a plurality of spaced-apart exit holes formed therein for providing a plurality of carrier-gas streams into the liquid chemical, where the carrier gas bubbles up through the liquid chemical, causing the liquid chemical to vaporize and diffuse into the carrier gas and causing the liquid chemical to be mixed to maintain a substantially uniform temperature throughout;

a vapor outlet tube connected to said bubbler chamber for passing the carrier gas and vaporized liquid chemical out of the bubbler chamber;

means for providing a substantially uniform temperature throughout said chemical liquid, said means including:

a heat-conductive enclosure formed of plates which are thicker than the walls of the bubbler chamber and which entirely surround the exterior surface of the bubbler chamber;

a heat-insulating layer surrounding the exterior surface of the heat conductive enclosure;

means connected to the heat-conductive enclosure for maintaining the temperature of the liquid chemical in the bubbler chamber at a predetermined temperature.

2. The bubbler system of claim 1 wherein said bubbler chamber wall portions are formed of stainless steel.

3. The bubbler system of claim 1 wherein said bubbler chamber is formed as a welded construction.

4. The bubbler system of claim 1 wherein said sparger tube extends horizontally adjacent to the bottom endwall portion of said bubbler chamber.

5. The bubbler system of claim 4 wherein said sparger tube includes a first plurality of exit holes horizontally positioned along a first side thereof.

6. The bubbler system of claim 5 including a second plurality of exit holes horizontally positioned along a side opposite said first side.

7. The bubbler system of claim 1 wherein said heat-conductive enclosure is formed of aluminum plates.

8. The bubbler system of claim 1 including heat-conductive means for providing thermal connection between said bubbler chamber and said heat-conductive enclosure.

9. The bubbler system of claim 1 including an insulated container for containing a plurality of bubbler systems.

10. The bubbler system of claim 1 wherein the means for maintaining the temperature of the liquid chemical in the bubbler chamber includes means for heating the heat-conductive enclosure.

11. The bubbler system of claim 1 wherein the means for maintaining the temperature of the liquid chemical in the bubbler chamber includes means for cooling the heat-conductive enclosure.

12. The bubbler system of claim 1 including a dimple formed in the bottom endwall to prevent reflection of light, provided by a laser liquid-level sensor unit, from the interior surface of the bottom end cap of the bubbler chamber.

13. The bubbler system of claim 1 wherein the liquid-chemical inlet tube terminates within a well formed in the bottom endwall adjacent an inlet end of the liquid-chemical inlet tube to facilitate back flushing of the bubbler chamber through the liquid-chemical inlet tube.

* * * * *

UNITED STATES PATENT AND TRADEMARK OFFICE

CERTIFICATE OF CORRECTION

PATENT NO. : 5,078,922

DATED : January 7, 1992

INVENTOR(S) : CRAIG C. COLLINS, ET AL.

It is certified that error appears in the above-identified patent and that said Letters Patent is hereby corrected as shown below:

ON THE TITLE PAGE:

In the abstract, line 23, Change "laser" to --optical--

At column 1, line 41, Change "if" to --is--

At column 2, line 23, Change "ION" to --DESCRIPTION--

At column 2, line 33, Change "1-1" to --2-2--

At column 3, line 1, Change "thermocouple" to --temperature sensor--

At column 3, line 12, Change "a laser" to --an optical--

At column 3, line 16, Change "thermocouple" to --temperature sensor--

At column 3, line 51, Before "36" insert --layer--

At column 3, line 51, after "the" insert --exterior surface--

At column 3, line 52, Delete "layer surrounding the exterior surface of the heat conductive enclosure."

At column 3, line 64, Change "surround" to --surrounds--

At column 4, line 5, Change "embodi-ments" to embodiments

At column 4, line 7, Change "applica-tion" to application

UNITED STATES PATENT AND TRADEMARK OFFICE

CERTIFICATE OF CORRECTION

PATENT NO. : 5,078,922

DATED : January 7, 1992

INVENTOR(S) : CRAIG C. COLLINS, ET AL

It is certified that error appears in the above-indentified patent and that said Letters Patent is hereby corrected as shown below:

At column 4, line 10, Change "con-templated." to contemplated.

Signed and Sealed this

Eighth Day of June, 1993

*Attest:*

*Attesting Officer*

Michael K. Kirk

MICHAEL K. KIRK

*Acting Commissioner of Patents and Trademarks*